US012576442B2

(12) United States Patent
Akashi et al.

(10) Patent No.: US 12,576,442 B2
(45) Date of Patent: Mar. 17, 2026

(54) WORKPIECE TRANSPORT DEVICE

(71) Applicant: KOMATSU INDUSTRIES CORPORATION, Kanazawa (JP)

(72) Inventors: Hidetoshi Akashi, Kanazawa (JP); Shigenori Sano, Kanazawa (JP); Yuji Sakaguchi, Kanazawa (JP)

(73) Assignee: KOMATSU INDUSTRIES CORPORATION, Kanazawa (JP)

( * ) Notice: Subject to any disclaimer, the term of this patent is extended or adjusted under 35 U.S.C. 154(b) by 300 days.

(21) Appl. No.: 18/280,805

(22) PCT Filed: Jan. 27, 2022

(86) PCT No.: PCT/JP2022/003087
§ 371 (c)(1),
(2) Date: Sep. 7, 2023

(87) PCT Pub. No.: WO2022/196122
PCT Pub. Date: Sep. 22, 2022

(65) Prior Publication Data

US 2024/0149326 A1 May 9, 2024

(30) Foreign Application Priority Data

Mar. 17, 2021 (JP) ..... 2021-043800

(51) Int. Cl.
*B21D 43/02* (2006.01)

(52) U.S. Cl.
CPC ..... *B21D 43/02* (2013.01)

(58) Field of Classification Search
CPC ..... B21D 43/02; B21D 43/04; B21D 43/052; B21D 43/12; B21D 43/18; B30B 15/30
See application file for complete search history.

(56) References Cited

U.S. PATENT DOCUMENTS 4,523,670 A 6/1985 Yanagisawa et al.
4,566,346 A * 1/1986 Petiteau ..... B23Q 1/621 74/89.22

(Continued)

FOREIGN PATENT DOCUMENTS

CN 101256943 A 9/2008
CN 101306454 A 11/2008

(Continued)

OTHER PUBLICATIONS

KR 20110072832A, Choi Jun. 2011.*
Translation KR 20110072832A, Choi Jun. 2011.*

*Primary Examiner* — Edward T Tolan
(74) *Attorney, Agent, or Firm* — Faegre Drinker Biddle & Reath LLP

(57) ABSTRACT

A workpiece transport device is downsized. A workpiece transport device includes: a pair of upstream-side end shaft and downstream-side end shafts disposed apart from each other in a transport direction that is a direction of transport of a workpiece, an upstream-side drive shaft disposed between a pair of upstream-side end shaft and downstream-side end shafts in the transport direction, an upstream-side drive belt wound around the upstream-side drive shaft and the upstream-side end shaft, and a transport belt wound around the pair of upstream-side end shaft and downstream-side end shaft. Driving force for transporting the workpiece is transmitted to the transport belt through the upstream-side drive shaft, the upstream-side drive belt, and the upstream-side end shaft in this order.

5 Claims, 7 Drawing Sheets

(56) References Cited

U.S. PATENT DOCUMENTS

| | | | | |
|---|---|---|---|---|
| 4,754,863 | A * | 7/1988 | Tsuchiya | B21D 43/105 72/422 |
| 4,942,958 | A * | 7/1990 | Marttila | B65G 23/12 198/833 |
| 5,383,348 | A * | 1/1995 | Michael | B21D 43/052 72/405.1 |
| 5,539,987 | A * | 7/1996 | Zennyoji | F16H 19/06 346/139 B |
| 7,189,049 | B1 * | 3/2007 | Blomgren | B25J 9/023 198/750.12 |
| 7,650,774 | B2 * | 1/2010 | Kato | B21D 43/05 72/405.01 |
| 2005/0178641 | A1 | 8/2005 | Yoshida et al. | |
| 2012/0211334 | A1 * | 8/2012 | Barnes | A21B 1/48 198/844.2 |
| 2015/0071740 | A1 | 3/2015 | Fujii | |
| 2016/0184879 | A1 | 6/2016 | Zulauf et al. | |

FOREIGN PATENT DOCUMENTS

| | | | |
|---|---|---|---|
| CN | 109292377 | A | 2/2019 |
| JP | S55-011279 | U | 1/1980 |
| JP | S58-134233 | U | 9/1983 |
| JP | S59-012011 | A | 1/1984 |
| JP | S59-197400 | A | 11/1984 |
| JP | S63-502732 | A | 10/1988 |
| JP | H01-14360 | Y2 | 4/1989 |
| JP | H05-138274 | A | 6/1993 |
| JP | H07-115096 | B2 | 12/1995 |
| JP | H09-2633 | A | 1/1997 |
| JP | 2740301 | B2 | 4/1998 |
| JP | 3182589 | B2 | 7/2001 |
| JP | 2003-062626 | A | 3/2003 |
| JP | 4093069 | B2 | 5/2008 |
| JP | 4198035 | B2 | 12/2008 |
| JP | 2009-056477 | A | 3/2009 |
| JP | 2010-046706 | A | 3/2010 |
| JP | 5140852 | B2 | 2/2013 |
| JP | 5193198 | B2 | 5/2013 |
| JP | 5951661 | B2 | 7/2016 |
| JP | 2016-528047 | A | 9/2016 |
| JP | 2018-144096 | A | 9/2018 |
| JP | 2019-138344 | A | 8/2019 |
| JP | 2019-155429 | A | 9/2019 |
| JP | 6789571 | B2 | 11/2020 |
| WO | 87/04646 | A1 | 8/1987 |
| WO | WO-2013/128942 | A1 | 9/2013 |

* cited by examiner

WORKPIECE TRANSPORT DEVICE

TECHNICAL FIELD

The present disclosure relates to a workpiece transport device.

BACKGROUND ART

Japanese Patent Laying-Open No. 2010-46706 (PTL 1) discloses a workpiece transport device that transports a workpiece that is a material to be worked between press machines.

The workpiece transport device described in PTL 1 includes a carrier extending in a transport direction of the workpiece, a subcarrier disposed movably along the carrier, a workpiece holding portion connected to the subcarrier, and a cable guide including a feeder to the workpiece holding portion. The carrier, the subcarrier, and the cable guide are disposed in substantially the same plane.

CITATION LIST

Patent Literature

PTL 1: Japanese Patent Laying-Open No. 2010-46706

SUMMARY OF INVENTION

Technical Problem

The workpiece transport device that transports the workpiece press-worked by a press machine is required to be downsized.

The present disclosure proposes a workpiece transport device that can be downsized.

Solution to Problem

According to the present disclosure, a workpiece transport device that transports a workpiece to be press-worked by at least one press machine is proposed. A workpiece transport device includes a pair of end shafts disposed apart from each other in a transport direction that is a direction of transport of a workpiece, a drive shaft disposed between the pair of end shafts in the transport direction, a drive belt wound around the drive shaft and the end shaft, and a transport belt wound around the pair of end shafts. Driving force for transporting the workpiece is transmitted to the transport belt through the drive shaft, the drive belt, and the end shaft in order.

Advantageous Effects of Invention

According to the present disclosure, the workpiece transport device can be downsized.

DESCRIPTION OF EMBODIMENT

Figure 1:
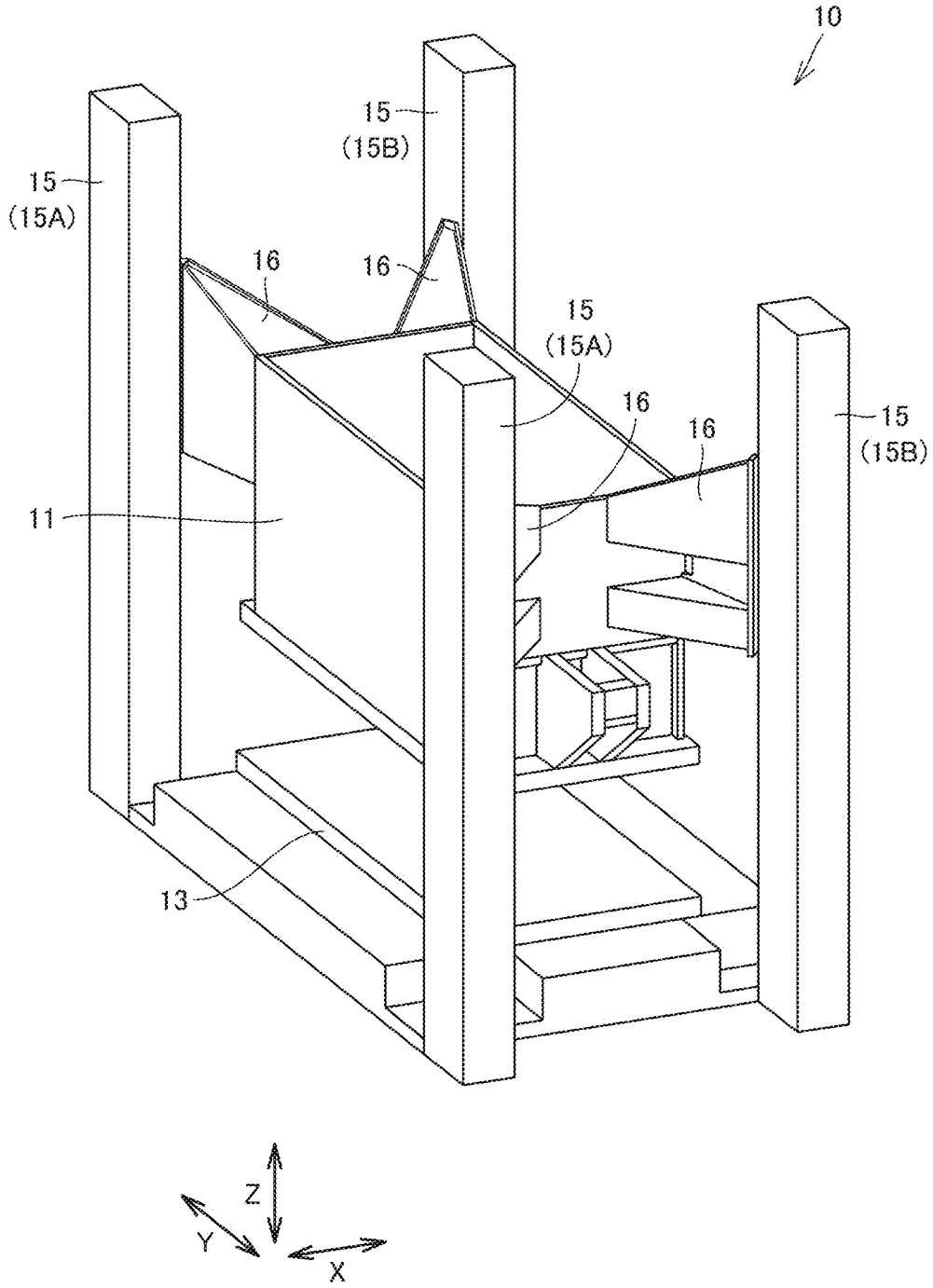
FIG. 1 is a perspective view illustrating a press machine.

Hereinafter, an embodiment will be described with reference to the drawings. In the following description, the same components are denoted by the same reference numerals. Names and functions of such components are also the same. Thus, the detailed description thereof will not be repeated.

FIG. 1 is a perspective view illustrating a press machine 10 that performs press working of a workpiece, a workpiece transport device according to an embodiment being applied to press machine 10. For example, the workpiece press-worked by a press system including press machine 10 and a press machine 20 described later is an exterior panel for an automobile. As illustrated in FIG. 1, press machine 10 mainly includes a slide 11, a bolster 13, and an upright 15.

Upright 15 is a columnar member extending in a vertical direction. Four uprights 15 are arranged at positions of respective vertexes of the rectangle in planar view. A crown (not illustrated) is supported by four uprights 15. A slide drive mechanism (not illustrated) that moves slide 11 up and down is accommodated in the crown. The crown is placed on top of four uprights. Upright 15 corresponds to the column portion of the present invention.

Slide 11 is disposed so as to be surrounded by four uprights 15. Slide 11 is suspended from the crown above upright 15, and is vertically movable with respect to the crown. An upper die 12 (not illustrated in FIG. 1) is detachably attached to a lower end of slide 11. Slide 11 is attached to upright 15 so as to be vertically movable by four slide arms 16. Slide arm 16 corresponds to the attachment portion of the present invention. Four slide arms 16 position slide 11 with respect to each of uprights 15. Slide arm 16 is slidable with respect to upright 15.

In the drawing, a transport direction X that is a direction in which the workpiece is transported, a vertical direction Z that is a direction in which upright 15 extends and in which slide 11 and upper die 12 move, and a crosswise direction Y that is a direction orthogonal to transport direction X and orthogonal to vertical direction Z are indicated by double-headed arrows. Four uprights 15 of press machine 10 include two uprights 15A on the upstream side in transport direction X and two uprights 15B on the downstream side in transport direction X.

Bolster 13 is disposed so as to be surrounded by four uprights 15. A lower die 14 is attached to the upper surface of bolster 13 (see FIG. 2, not illustrated in FIG. 1). As slide 11 moves in vertical direction Z, upper die 12 moves integrally with slide 11 in vertical direction Z, and upper die 12 approaches and separates from lower die 14. The workpiece is sandwiched between upper die 12 and lower die 14, and the workpiece is press-worked.

Figure 2:
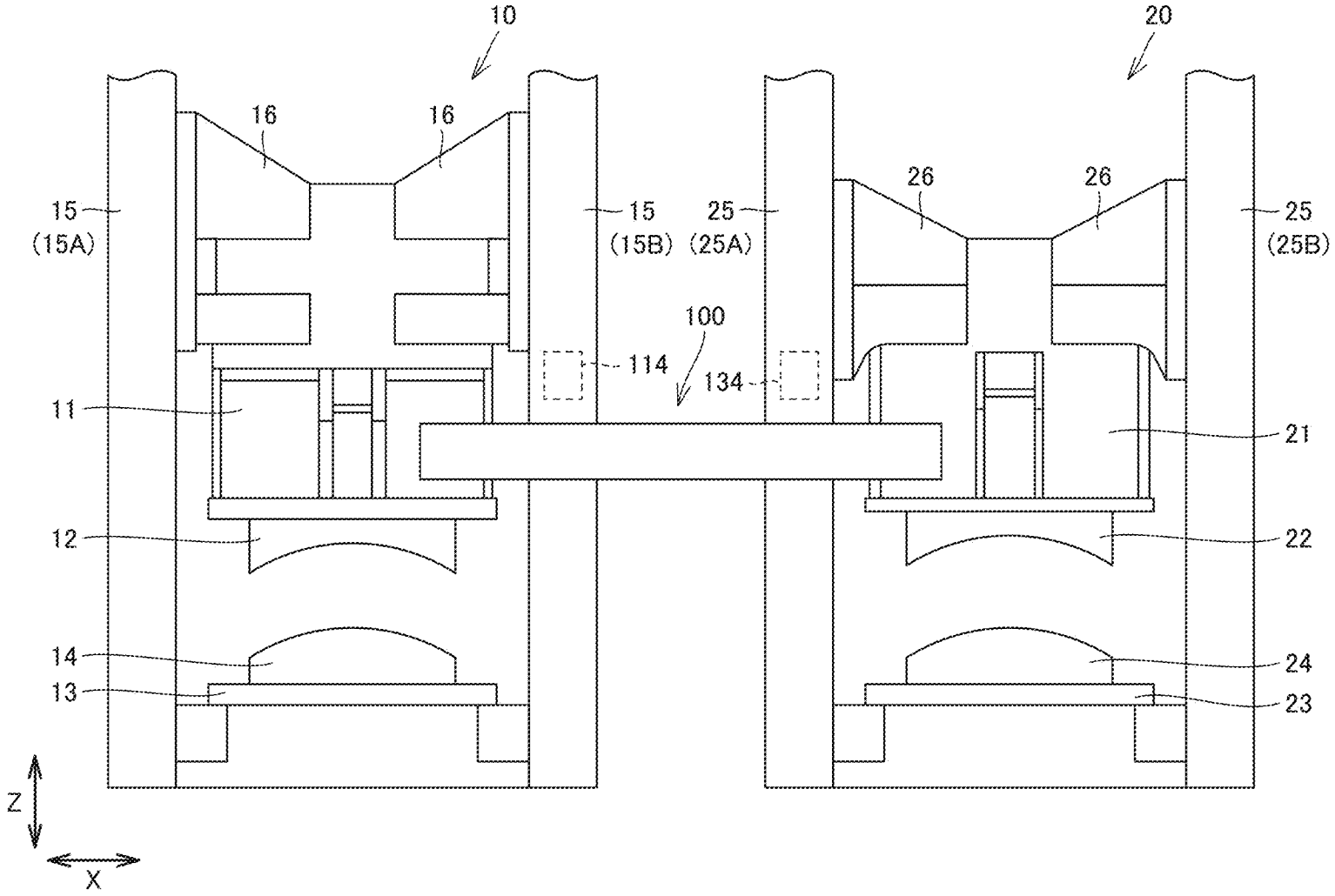
FIG. 2 is a side view illustrating a press system.

FIG. 2 is a side view illustrating a press system including a plurality of press machines and a workpiece transport device 100 that transports the workpiece between the press machines. FIG. 2 illustrates two press machines 10, 20 among a plurality of press machines included in the press system, and workpiece transport device 100 illustrated in a simplified manner. Workpiece transport device 100 is provided between press machine 10 and press machine 20. Workpiece transport device 100 transports the workpiece from press machine 10 on the upstream side to press machine 20 on the downstream side in transport direction X.

Press machine 10 and press machine 20 are arranged side by side at intervals in transport direction X. Similarly to press machine 10 described with reference to FIG. 1, press machine 20 includes a slide 21, an upper die 22, a bolster 23, a lower die 24, four uprights 25, and four slide arms 26. Four uprights 25 of press machine 20 include two uprights 25A on the upstream side in transport direction X and two uprights 25B on the downstream side in transport direction X.

Workpiece transport device 100 transports the workpiece press-molded by upstream-side press machine 10 to downstream-side press machine 20. The workpiece sandwiched and press-worked between upper die 12 and lower die 14 of press machine 10 is transferred from press machine 10 to press machine 20, and then sandwiched and press-worked between upper die 22 and lower die 24 of press machine 20. The plurality of press machines including press machines 10, 20 constitute a tandem press line, and sequentially process the workpiece.

Figure 3:
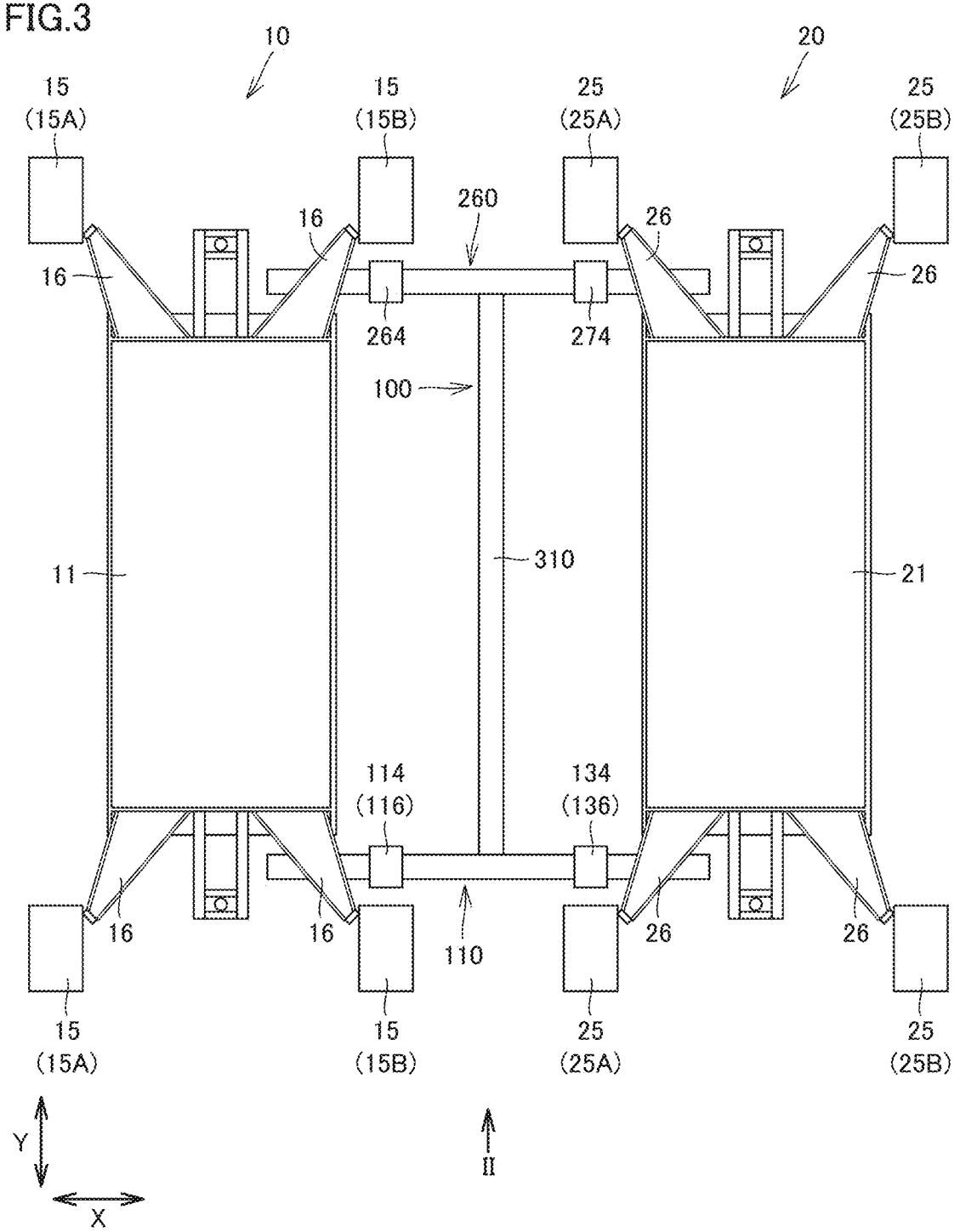
FIG. 3 is a plan view illustrating the press system.

FIG. 3 is a plan view illustrating the press system in FIG. 2. FIG. 2 illustrates a side view illustrating the press system viewed from a direction of an arrow II in FIG. 3.

Workpiece transport device 100 includes a first drive 110 disposed on one side in crosswise direction Y and a second drive 260 disposed on the other side in crosswise direction Y. Workpiece transport device 100 further includes a crossbar 310. Crossbar 310 extends in crosswise direction Y.

Crossbar 310 includes one end supported by first drive 110 and the other end supported by second drive 260. Crossbar 310 is bridged between first drive 110 and second drive 260.

Crossbar 310 holds the workpiece at an intermediate portion between the one end and the other end. Crossbar 310 corresponds to the holding portion of the embodiment. For example, crossbar 310 includes a vacuum cup in the intermediate portion, and can hold the workpiece by sucking the workpiece using vacuum.

After the press working of the workpiece by press machine 10 is completed, crossbar 310 enters between upper die 12 and lower die 14 to hold the workpiece. When first drive 110 and second drive 260 move crossbar 310 along a predetermined operation trajectory while crossbar 310 holds the workpiece, the workpiece is transported from press machine 10 to press machine 20. When crossbar 310 enters between upper die 22 and lower die 24 of press machine 20 and releases the holding of the workpiece, whereby the workpiece is delivered to press machine 20.

Figure 4:
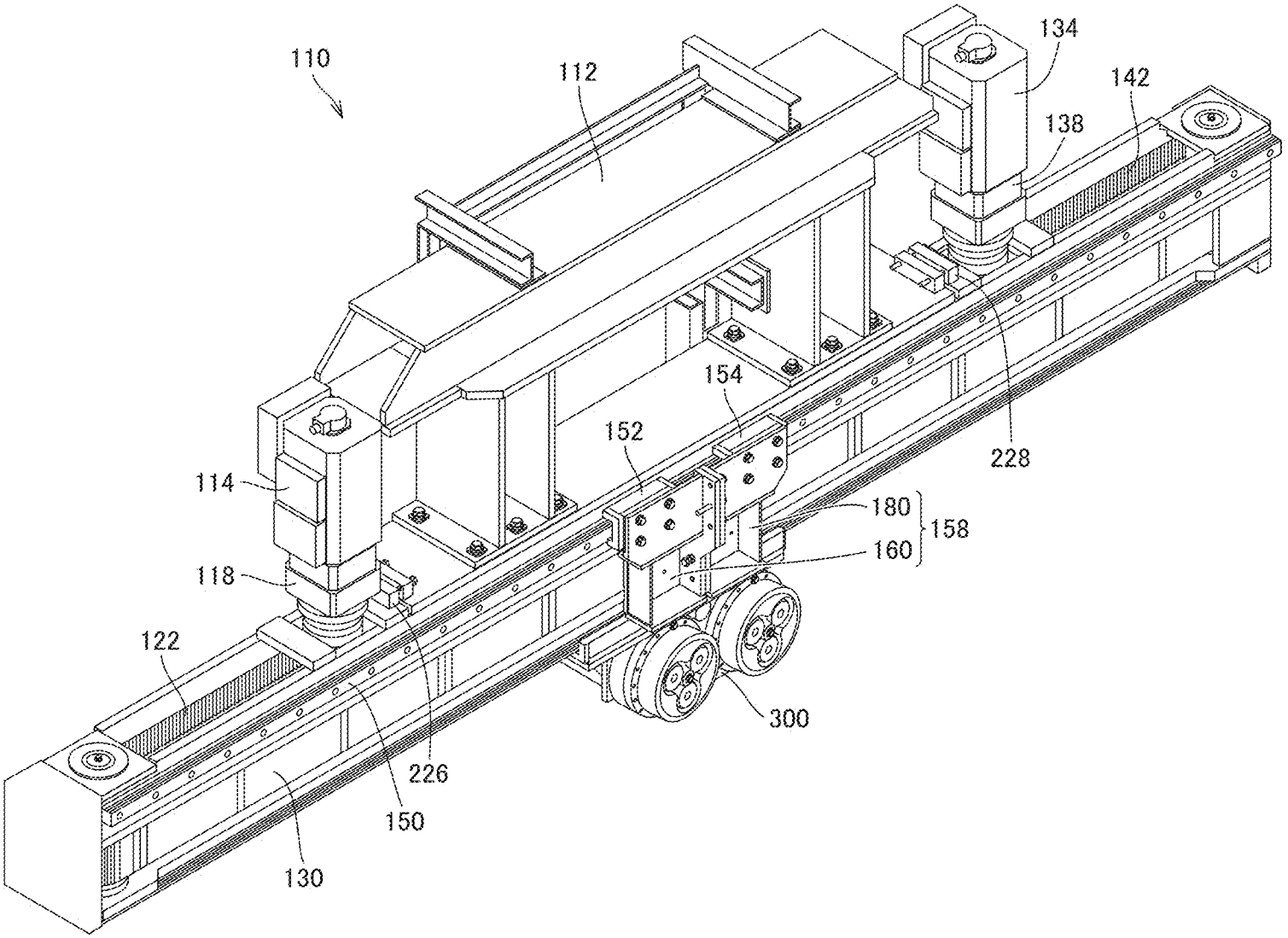
FIG. 4 is a perspective view illustrating a first drive constituting a workpiece transport device.

FIG. 4 is a perspective view illustrating first drive 110 constituting workpiece transport device 100. First drive 110 includes a frame 112. Frame 112 is fixed to upright 15B of press machine 10 and upright 25A of press machine 20. Frame 112 extends in transport direction X.

Frame 112 supports an upstream-side motor 114 at an upstream-side end in transport direction X. Frame 112 supports a downstream-side motor 134 at the downstream-side end in transport direction X. In transport direction X, upstream-side motor 114 is disposed on the upstream side of downstream-side motor 134, and downstream-side motor 134 is disposed on the downstream side of upstream-side motor 114. Upstream-side motor 114 and downstream-side motor 134 generate driving force for transporting the workpiece.

Figure 5:
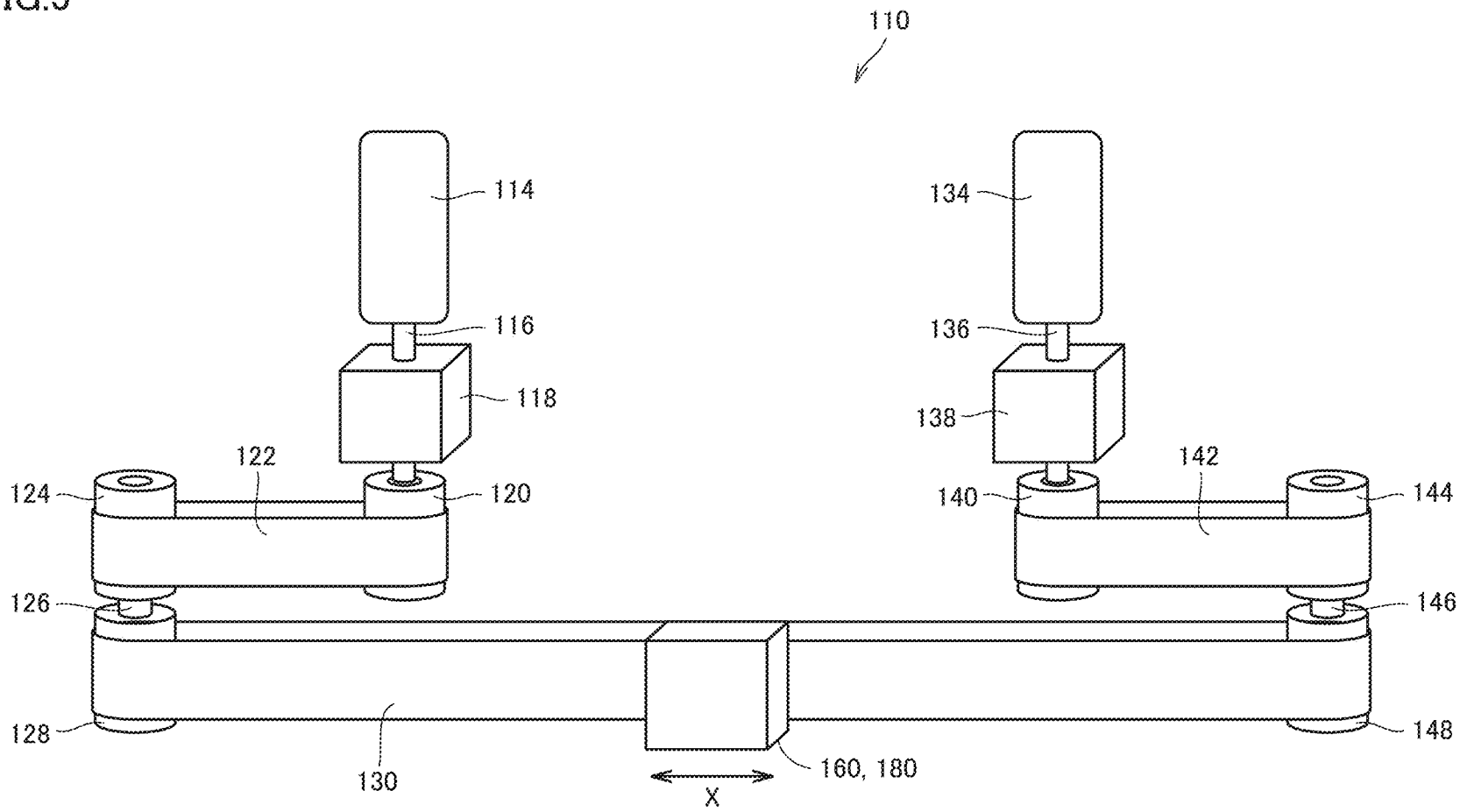
FIG. 5 is a schematic view illustrating a power transmission device included in the first drive in FIG. 4.

FIG. 5 is a schematic view illustrating a power transmission device that is included in first drive 110 in FIG. 4 and transmits the driving force generated by upstream-side motor 114 and downstream-side motor 134. The driving force of upstream-side motor 114 is output to an upstream-side drive shaft 116. Upstream-side motor 114 is an upstream-side actuator that generates the driving force rotationally driving upstream-side drive shaft 116. An upstream-side speed reducer 118 is provided in upstream-side drive shaft 116. Upstream-side speed reducer 118 decelerates the rotation generated by upstream-side motor 114 and increases driving torque.

The driving force of downstream-side motor 134 is output to a downstream-side drive shaft 136. Downstream-side motor 134 is a downstream-side actuator that generates the driving force rotationally driving downstream-side drive shaft 136. A downstream-side speed reducer 138 is provided in downstream-side drive shaft 136. Downstream-side speed reducer 138 decelerates the rotation generated by downstream-side motor 134 and increases the driving torque.

Upstream-side drive shaft 116 includes an upstream-side first pulley 120 at the lower end of upstream-side drive shaft 116. Upstream-side drive belt 122 is wound around upstream-side first pulley 120. Downstream-side drive shaft 136 includes a downstream-side first pulley 140 at the lower end of downstream-side drive shaft 136. Downstream-side drive belt 142 is wound around downstream-side first pulley 140.

An upstream-side end shaft 126 is disposed on the upstream side in transport direction X with respect to upstream-side drive shaft 116. Upstream-side end shaft 126 includes an upstream-side second pulley 124 at the upper end of upstream-side end shaft 126, and includes an upstream-side third pulley 128 at the lower end of upstream-side end shaft 126. Upstream-side second pulley 124 and upstream-side third pulley 128 are integrally rotatable. Upstream-side drive belt 122 is wound around upstream-side second pulley 124. A transport belt 130 is wound around upstream-side third pulley 128.

Upstream-side drive belt 122 is wound around upstream-side drive shaft 116 through upstream-side first pulley 120 and wound around upstream-side end shaft 126 through upstream-side second pulley 124. A downstream end in transport direction X of upstream-side drive belt 122 is wound around upstream-side drive shaft 116. An upstream end in transport direction X of upstream-side drive belt 122 is wound around upstream-side end shaft 126. Both ends in transport direction X of upstream-side drive belt 122 are wound around a pair of upstream-side drive shaft 116 and upstream-side end shaft 126.

A downstream-side end shaft 146 is disposed on the downstream side in transport direction X with respect to downstream-side drive shaft 136. Downstream-side end shaft 146 includes a downstream-side second pulley 144 at the upper end of downstream-side end shaft 146, and includes a downstream-side third pulley 148 at the lower end of downstream-side end shaft 146. Downstream-side second pulley 144 and downstream-side third pulley 148 are integrally rotatable. Downstream-side drive belt 142 is wound around downstream-side second pulley 144. Transport belt 130 is wound around downstream-side third pulley 148.

Downstream-side drive belt 142 is wound around downstream-side drive shaft 136 through downstream-side first pulley 140, and wound around downstream-side end shaft 146 through downstream-side second pulley 144. The upstream end of downstream-side drive belt 142 in transport direction X is wound around downstream-side drive shaft 136. The downstream end of downstream-side drive belt 142 in transport direction X is wound around downstream-side end shaft 146. Both ends of downstream-side drive belt 142 in transport direction X are wound around a pair of downstream-side drive shaft 136 and downstream-side end shaft 146.

The driving force generated by upstream-side motor 114 is transmitted to transport belt 130 through upstream-side drive belt 122. The driving force generated by downstream-side motor 134 is transmitted to transport belt 130 through downstream-side drive belt 142. Upstream-side drive belt 122 and downstream-side drive belt 142 extend in transport direction X. Transport belt 130 extends in transport direction X. An axis at the upstream end of transport belt 130 in transport direction X is coaxial with an axis at the upstream end in transport direction X of upstream-side drive belt 122. The axis at the downstream end in transport direction X of transport belt 130 is coaxial with the axis at the downstream end in transport direction X of downstream-side drive belt 142.

Transport belt 130 is configured as a belt member different from upstream-side drive belt 122 and downstream-side drive belt 142. Transport belt 130 is wound around upstream-side end shaft 126 through upstream-side third pulley 128, and wound around downstream-side end shaft 146 through downstream-side third pulley 148. The upstream end in transport direction X of transport belt 130 is wound around upstream-side end shaft 126. The downstream end in transport direction X of transport belt 130 is wound around downstream-side end shaft 146. Both ends in transport direction X of transport belt 130 are wound around a pair of upstream-side end shaft 126 and downstream-side end shaft 146.

Upstream-side drive shaft 116, upstream-side speed reducer 118, upstream-side first pulley 120, upstream-side drive belt 122, upstream-side second pulley 124, upstream-side end shaft 126, and upstream-side third pulley 128 constitute the power transmission device that transmits the driving force generated by upstream-side motor 114 to transport belt 130. The driving force, for transporting the workpiece, generated by upstream-side motor 114 is transmitted to transport belt 130 through upstream-side drive shaft 116, upstream-side speed reducer 118, upstream-side first pulley 120, upstream-side drive belt 122, upstream-side second pulley 124, upstream-side end shaft 126, and upstream-side third pulley 128 in order.

Downstream-side drive shaft 136, downstream-side speed reducer 138, downstream-side first pulley 140, downstream-side drive belt 142, downstream-side second pulley 144, downstream-side end shaft 146, and downstream-side third pulley 148 constitute the power transmission device that transmits the driving force generated by downstream-side motor 134 to transport belt 130. The driving force, for transporting the workpiece, generated by downstream-side motor 134 is transmitted to transport belt 130 through downstream-side drive shaft 136, downstream-side speed reducer 138, downstream-side first pulley 140, downstream-side drive belt 142, downstream-side second pulley 144, downstream-side end shaft 146, and downstream-side third pulley 148 in order.

Upstream-side drive shaft 116 extends downward from upstream-side motor 114. Downstream-side drive shaft 136 extends downward from downstream-side motor 134. In planar view from above, upstream-side drive shaft 116 overlaps upstream-side motor 114. In planar view from above, downstream-side drive shaft 136 overlaps downstream-side motor 134.

Upstream-side drive belt 122 is disposed below upstream-side motor 114. Downstream-side drive belt 142 is disposed below downstream-side motor 134. Transport belt 130 is disposed below upstream-side drive belt 122 and downstream-side drive belt 142. In planar view from above, upstream-side motor 114, upstream-side drive belt 122, and transport belt 130 overlap each other. In planar view from above, downstream-side motor 134, downstream-side drive belt 142, and transport belt 130 overlap each other.

Figure 6:
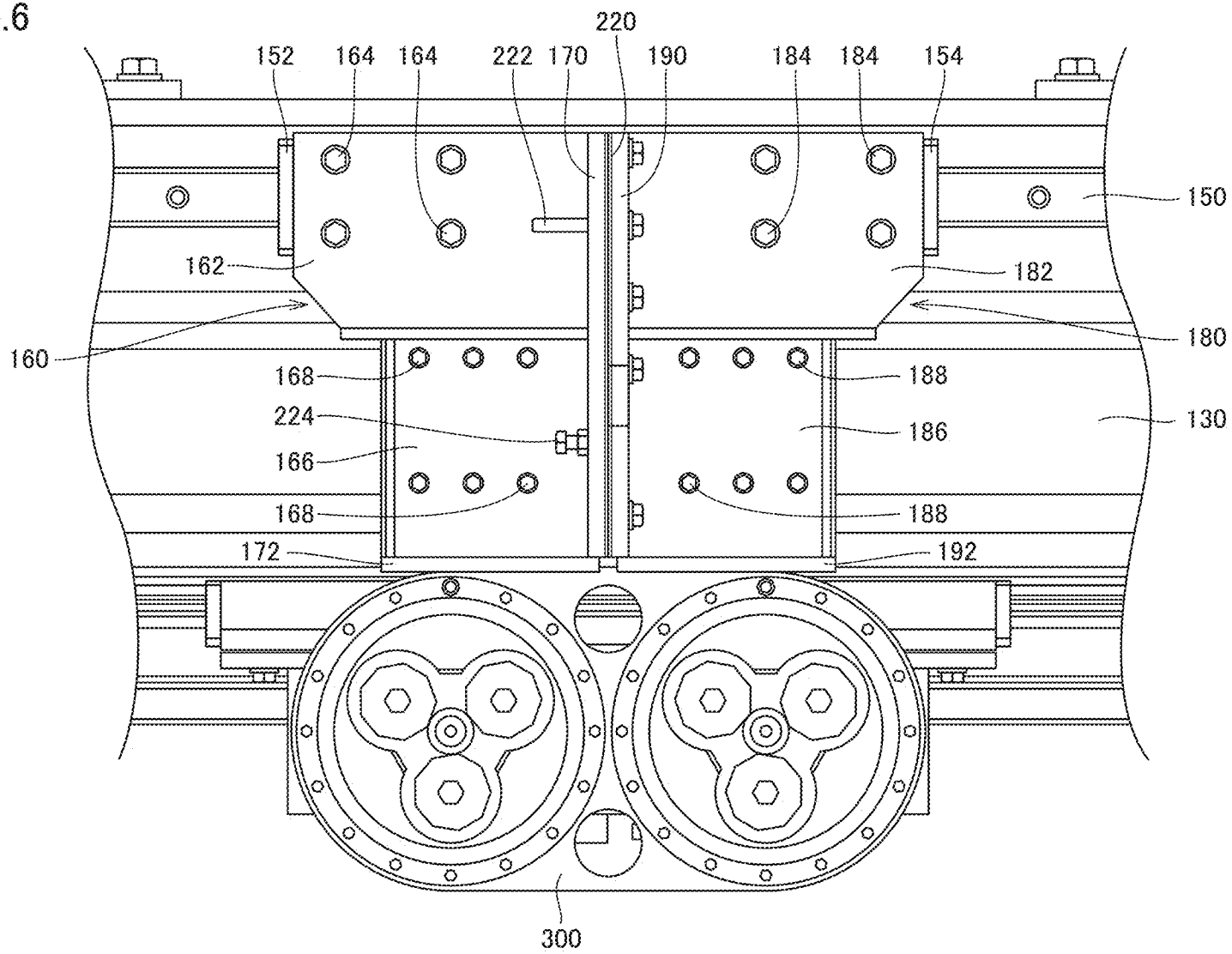
FIG. 6 is an enlarged front view illustrating the first drive in the vicinity of a first carrier and a second carrier.
Figure 7:
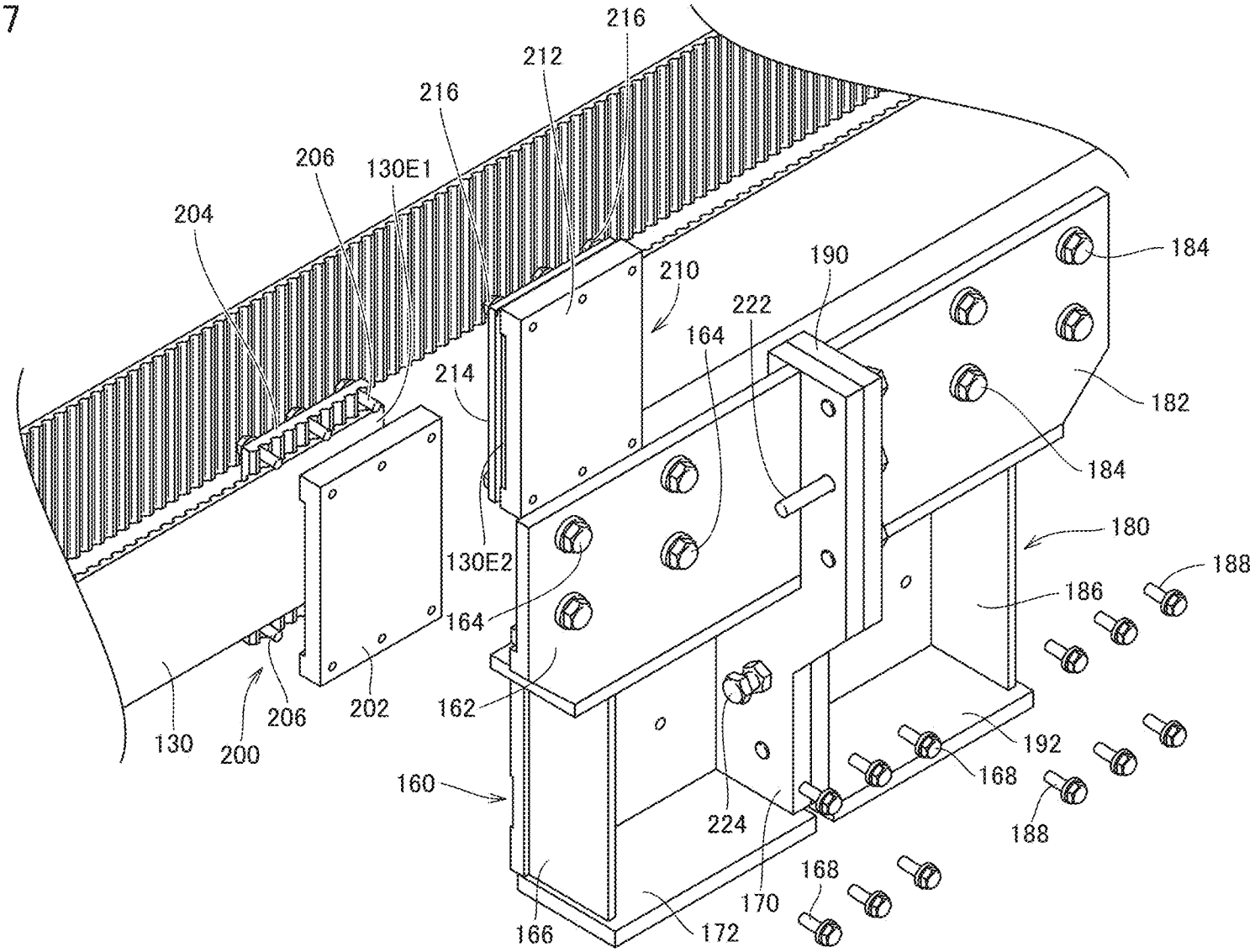
FIG. 7 is a perspective view illustrating a state in which the first carrier and the second carrier are attached to a transport belt.

A carrier 158 is fixed to transport belt 130. Carrier 158 includes a first carrier 160 on the upstream side in transport direction X and a second carrier 180 on the downstream side in transport direction X. First carrier 160 and second carrier 180 are configured as separate members, arranged adjacent to each other in transport direction X, and integrated by bolt coupling. With reference to FIGS. 6 and 7, details of a structure in which first carrier 160 and second carrier 180 are integrated will be described later.

First carrier 160 and second carrier 180 are integrally moved in transport direction X by the operation of transport belt 130. That is, when upstream-side speed reducer 118 and downstream-side speed reducer 138 are operated in synchronization, transport belt 130 is driven, and carrier 158 (first carrier 160 and second carrier 180) provided on transport belt 130 is moved in transport direction X.

A base portion 300 is suspended and supported by first carrier 160 and second carrier 180. Crossbar 310 in FIG. 3 is connected to base portion 300 with an arm portion (not illustrated) interposed therebetween. Transport belt 130 moves crossbar 310 in transport direction X through base portion 300. The operation of transport belt 130 causes the workpiece held by crossbar 310 to be transported in transport direction X. Crossbar 310 may be configured to be relatively movable with respect to base portion 300 by driving the arm portion, and an actuator that generates the driving force for the relative movement may be mounted on base portion 300.

A linear motion member 152 is fixed to first carrier 160. A linear motion member 154 is fixed to second carrier 180. Linear motion member 152, 154 are assembled to a guide rail 150 and supported by guide rail 150. Guide rail 150 extends in transport direction X. A length of transport belt 130 in transport direction X is substantially equal to a length of guide rail 150 in transport direction X. Guide rail 150 is configured to be immovable in transport direction X. Linear motion member 152, 154 are linearly reciprocable in transport direction X along guide rail 150.

Guide rail 150 supports first carrier 160 and second carrier 180 with linear motion member 152, 154 interposed therebetween. A weight acting on first carrier 160 and second carrier 180 is supported by guide rail 150. First carrier 160 and second carrier 180 are guided by guide rail 150 and can linearly move along transport direction X.

The pair of upstream-side end shaft 126 and downstream-side end shaft 146 is disposed apart from each other in transport direction X. The pair of upstream-side end shaft 126 and downstream-side end shaft 146 is provided at both ends in a longitudinal direction of guide rail 150 in FIG. 4. The pair of upstream-side drive shaft 116 and downstream-side drive shaft 136 is provided inside the pair of upstream-side end shaft 126 and downstream-side end shaft 146 in the longitudinal direction of guide rail 150. Upstream-side drive shaft 116 and downstream-side drive shaft 136 are disposed between the pair of upstream-side end shafts 126 and downstream-side end shaft 146 in transport direction X. The upstream-side drive shaft 116 and downstream-side drive shaft 136 are disposed on the downstream side in transport direction X with respect to upstream-side end shaft 126, and disposed on the upstream side in transport direction X with respect to downstream-side end shaft 146.

With reference to FIGS. 2 and 3, the lengths in transport direction X of transport belt 130 and guide rail 150 is greater than the interval between press machines 10, 20.

Transport belt 130 and guide rail 150 extend to the upstream side in transport direction X beyond upright 15B on the downstream side of press machine 10. The upstream ends in transport direction X of transport belt 130 and guide rail 150 are located on the upstream side in transport direction X with respect to upright 15B on the downstream side of press machine 10. Parts of transport belt 130 and guide rail 150 are disposed inside press machine 10.

Transport belt 130 and guide rail 150 extend to the downstream side in transport direction X beyond upright 25A on the upstream side of press machine 20. The downstream ends in transport direction X of transport belt 130 and guide rail 150 are located on the downstream side in transport direction X with respect to upright 25A on the upstream side of press machine 20. Parts of transport belt 130 and guide rail 150 are disposed inside press machine 20.

Transport belt 130 and guide rail 150 are disposed outside slides 11, 21 in crosswise direction Y. Transport belt 130 and guide rail 150 are disposed between slide 11 and upright 15B and between slide 21 and upright 25A in crosswise direction Y. In planar view, transport belt 130 and guide rail 150 overlap slide arms 16, 26.

Transport belt 130 and guide rail 150 extend in transport direction X by the length from slide 11 of press machine 10 to slide 21 of press machine 20. As illustrated in FIG. 2, the upstream ends and the downstream ends in transport direction X of transport belt 130 and guide rail 150 overlap slides 11, 21, respectively, when viewed from the direction orthogonal to a plane defined by transport direction X and vertical direction Z, namely, when viewed in crosswise direction Y (the direction perpendicular to a paper surface in FIG. 2).

Entire first drive 110 is disposed so as not to interfere with slide arms 16, 26. In first drive 110, a portion located on the upstream side in transport direction X with respect to upstream-side motor 114, more specifically, a portion including upstream-side drive belt 122, upstream-side end shaft 126, transport belt 130, and guide rail 150 is disposed below slide arm 16 of press machine 10. In first drive 110, a portion located on the downstream side in transport direction X of downstream-side motor 134, more specifically, a portion including downstream-side drive belt 142, downstream-side end shaft 146, transport belt 130, and guide rail 150 is disposed below slide arm 26 of press machine 20.

Upstream-side drive belt 122, downstream-side drive belt 142, transport belt 130, and guide rail 150 are disposed below the lower limit position of a movable range of slide arms 16, 26 movable in the vertical direction. Crossbar 310 is disposed below transport belt 130 and guide rail 150 and away from transport belt 130.

With reference to FIGS. 2 and 3 again, when viewed in crosswise direction Y (the direction perpendicular to the paper surface in FIG. 2), upstream-side motor 114 overlaps upright 15B on the downstream side of press machine 10, and downstream-side motor 134 overlaps upright 25A on the upstream side of press machine 20. Among four slide arms 16 of press machine 10, upstream-side motor 114 and downstream-side motor 134 are disposed on the downstream side in transport direction X with respect to slide arm 16 on the downstream side in transport direction X. Among four slide arms 26 of press machine 20, upstream-side motor 114 and downstream-side motor 134 are disposed on the upstream side in transport direction X with respect to slide arm 26 on the upstream side in transport direction X. Upstream-side motor 114 and downstream-side motor 134 are disposed on the downstream side in transport direction X with respect to slide 11 of press machine 10, and disposed on the upstream side in transport direction X with respect to slide 21 of press machine 20.

As illustrated in FIG. 3, on the XY-plane, upstream-side drive shaft 116 is located at the same position as upstream-side motor 114, and downstream-side drive shaft 136 is located at the same position as downstream-side motor 134. Accordingly, upstream-side drive shaft 116 and downstream-side drive shaft 136 are disposed on the downstream side in transport direction X with respect to slide 11 of press machine 10, and disposed on the upstream side in transport direction X with respect to slide 21 of press machine 20. Upstream-side drive shaft 116 and downstream-side drive shaft 136 are disposed between slide 11 of press machine 10 and slide 21 of press machine 20 in the transport direction X.

Upstream-side drive shaft 116 and downstream-side drive shaft 136 are disposed on the downstream side in transport direction X with respect to slide arm 16 on the downstream side in transport direction X among four slide arms 16 of press machine 10. Upstream-side drive shaft 116 and downstream-side drive shaft 136 are disposed on the upstream side in transport direction X with respect to slide arm 26 on the upstream side in transport direction X among four slide arms 26 of press machine 20. Upstream-side drive shaft 116 and downstream-side drive shaft 136 are disposed between slide arm 16 on the downstream side in transport direction X of press machine 10 and slide arm 26 on the upstream side in transport direction X of press machine 20 in transport direction X.

Upstream-side motor 114 and downstream-side motor 134, upstream-side drive shaft 116 and downstream-side drive shaft 136, and upstream-side speed reducer 118 and downstream-side speed reducer 138 are disposed in a space between press machine 10 on the upstream side and press machine 20 on the downstream side.

FIG. 6 is an enlarged front view illustrating first drive 110 in the vicinity of first carrier 160 and second carrier 180. FIG. 7 is a perspective view illustrating a state in which first carrier 160 and second carrier 180 are attached to transport belt 130. Transport belt 130 is an ended belt having a first end 130E1 and a second end 130E2. Transport belt 130 is a toothed belt including teeth on an inner peripheral surface.

A belt fastening plate 200 is attached to first end 130E1 of transport belt 130. Belt fastening plate 200 includes an outer plate 202 facing the outer peripheral surface of transport belt 130 and an inner plate 204 facing the inner peripheral surface of transport belt 130. Outer plate 202 and inner plate 204 sandwich first end 130E1 of transport belt 130 and are integrally connected by a plurality of fastening bolts 206.

A belt fastening plate 210 is attached to second end 130E2 of transport belt 130. Belt fastening plate 210 includes an outer plate 212 facing the outer peripheral surface of transport belt 130 and an inner plate 214 facing the inner peripheral surface of transport belt 130. Outer plate 212 and inner plate 214 sandwich second end 130E2 of transport belt 130 and are integrally connected by a plurality of fastening bolts 216.

First carrier 160 includes a rail support 162 and a belt fixture 166. Rail support 162 is connected to linear motion member 152 by a plurality of support bolts 164. Belt fixture 166 is connected to outer plate 202 of belt fastening plate 200 by a plurality of fixing bolts 168.

Second carrier 180 includes a rail support 182 and a belt fixture 186. Rail support 182 is connected to linear motion member 154 by a plurality of support bolts 184. Belt fixture 186 is connected to outer plate 212 of belt fastening plate 210 by a plurality of fixing bolts 188.

When rail support 162 is fixed to linear motion member 152 and when rail support 182 is fixed to linear motion member 154, first carrier 160 and second carrier 180 are supported by guide rail 150 as described above.

When belt fixture 166 is fixed to belt fastening plate 200 and when belt fixture 186 is fixed to belt fastening plate 210, first carrier 160 and second carrier 180 are moved in transport direction X by transport belt 130 as described above.

First carrier 160 includes a bottom plate portion 172. Second carrier 180 includes a bottom plate portion 192. Base portion 300 is suspended downward from bottom plate portions 172, 192 and supported by first carrier 160 and second carrier 180.

First carrier 160 includes a wall portion 170 extending in the vertical direction. Second carrier 180 includes a wall portion 190 extending in the vertical direction. Wall portion 170 constitutes an edge portion of first carrier 160 on the downstream side in transport direction X. Wall portion 190 constitutes an edge portion of second carrier 180 on the upstream side in transport direction X.

Wall portion 170 of first carrier 160 and wall portion 190 of second carrier 180 are disposed so as to face each other, a shim plate 220 is sandwiched between wall portion 170 and wall portion 190, and wall portion 170, shim plate 220, and wall portion 190 are fastened by shim adjusting bolts 222, 224, whereby first carrier 160 and second carrier 180 are connected.

The interval between wall portion 170 and wall portion 190 is adjusted by adjusting a fastening amount of shim adjusting bolts 222, 224 with respect to wall portions 170, 190. Thus, the interval between first end 130E1 and second end 130E2 in the transport direction X of transport belt 130 can be adjusted.

Shim plate 220 is sandwiched instead of forming the interval between wall portion 170 and wall portion 190. Shim plate 220 having an appropriate thickness is selected from the length of transport belt 130, a spring constant of transport belt 130, and the like, and shim plate 220 having the appropriate thickness is sandwiched between wall portion 170 and wall portion 190. Shim plate 220 is used to adjust the interval between wall portion 170 and wall portion 190, whereby the interval between first end 130E1 and second end 130E2 of ended transport belt 130 is adjusted, so that tension of transport belt 130 can be reliably adjusted. When shim plate 220 is sandwiched, the tension of transport belt 130 can be constantly managed regardless of a service worker.

On the other hand, upstream-side drive belt 122 and downstream-side drive belt 142 are endless belts as illustrated in the schematic diagram of FIG. 5. The tension of upstream-side drive belt 122 is adjusted by adjusting the relative position of upstream-side drive shaft 116 with respect to upstream-side end shaft 126 in transport direction X. The tension of downstream-side drive belt 142 is adjusted by adjusting the relative position of downstream-side drive shaft 136 with respect to downstream-side end shaft 146 in transport direction X.

Specifically, upstream-side end shaft 126 is configured to be immovable in transport direction X, and an assembly including upstream-side motor 114, upstream-side drive shaft 116, upstream-side speed reducer 118, and upstream-side first pulley 120 is configured to be movable in transport direction X. The tension of upstream-side drive belt 122 can be reduced by bringing upstream-side drive shaft 116 closer to upstream-side end shaft 126, and the tension of upstream-side drive belt 122 can be increased by separating upstream-side drive shaft 116 from upstream-side end shaft 126.

As illustrated in FIG. 4, a shim plate 226 is provided on the downstream side in transport direction X of upstream-side drive shaft 116. Shim plate 226 can be used to adjust the position in transport direction X of upstream-side drive shaft 116. The tension of upstream-side drive belt 122 can be appropriately adjusted using appropriate shim plate 226 selected from the length of upstream-side drive belt 122, the spring constant of upstream-side drive belt 122, and the like.

Similarly, downstream-side end shaft 146 is configured to be immovable in transport direction X, and an assembly including downstream-side motor 134, downstream-side drive shaft 136, downstream-side speed reducer 138, and downstream-side first pulley 140 is configured to be movable in transport direction X. The tension of downstream-side drive belt 142 can be reduced by bringing downstream-side drive shaft 136 closer to downstream-side end shaft 146, and the tension of downstream-side drive belt 142 can be increased by separating downstream-side drive shaft 136 from downstream-side end shaft 146.

As illustrated in FIG. 4, a shim plate 228 is provided on the upstream side in transport direction X of downstream-side drive shaft 136. Shim plate 228 can be used to adjust the position in transport direction X of downstream-side drive shaft 136. The tension of downstream-side drive belt 142 can be appropriately adjusted using appropriate shim plate 228 selected from the length of downstream-side drive belt 142, the spring constant of downstream-side drive belt 142, and the like.

Second drive 260 in FIG. 3 has the same configuration as first drive 110 described above. Second drive 260 includes motors 264, 274 that generate the driving force for transporting the workpiece. With reference to the disposition of motors 264, 274 in FIG. 3, the drive shaft to which the driving force of motors 264, 274 is transmitted is disposed between slide 11 of press machine 10 and slide 21 of press machine 20 in transport direction X. The drive shaft is disposed between slide arm 16 on the downstream side of press machine 10 and slide arm 26 on the upstream side of press machine 20.

Although there is a description partially overlapping with the above description, the characteristic configurations and effects of the embodiment will be collectively described as follows.

As illustrated in FIG. 5, workpiece transport device 100 of the embodiment includes the pair of upstream-side end shaft 126 and downstream-side end shafts 146 disposed apart from each other in transport direction X that is the direction of the transport of the workpiece, upstream-side drive shaft 116 disposed between the pair of upstream-side end shaft 126 and downstream-side end shafts 146 in transport direction X, upstream-side drive belt 122 wound around upstream-side drive shaft 116 and upstream-side end shaft 126, and transport belt 130 wound around the pair of upstream-side end shaft 126 and downstream-side end shaft 146. The driving force for transporting the workpiece is transmitted to transport belt 130 through upstream-side drive shaft 116, upstream-side drive belt 122, and upstream-side end shaft 126 in this order.

Because workpiece transport device 100 includes upstream-side drive belt 122 and transport belt 130 separately, a degree of freedom in design allowed for the relative position of upstream-side drive shaft 116 with respect to upstream-side end shaft 126 increases. Accordingly, workpiece transport device 100 can be downsized such that upstream-side drive belt 122 is disposed so as to return back at upstream-side end shaft 126 with respect to transport belt 130, and such that upstream-side drive shaft 116 is disposed between the pair of upstream-side end shaft 126 and downstream-side end shaft 146. The space of workpiece transport device 100 is saved, so that upstream-side drive shaft 116 can be disposed in the space between the press machines 10, 20 as illustrated in FIGS. 2 and 3. With such the configuration, workpiece transport device 100 can be operated to transport the workpiece without interfering with the operations of press machines 10, 20.

As illustrated in FIG. 3, upstream-side drive shaft 116 and downstream-side drive shaft 136 are disposed between slide 11 of press machine 10 on the upstream side and slide 21 of press machine 20 on the downstream side. Thus, it is possible to avoid that the operations of slides 11, 21 moving in the vertical direction are hindered by upstream-side drive shaft 116 or downstream-side drive shaft 136.

As illustrated in FIG. 3, upstream-side drive shaft 116 and downstream-side drive shaft 136 are disposed between slide arm 16 of press machine 10 on the upstream side and slide arm 26 of press machine 20 on the downstream side. Thus, it is possible to avoid that the operations of slide arms 16, 26 moving in the vertical direction are hindered by upstream-side drive shaft 116 or downstream-side drive shaft 136.

As illustrated in FIG. 2, transport belt 130 is disposed below slide arms 16, 26. The interference between workpiece transport device 100 and press machines 10, 20 is reliably avoided, so that productivity of the press working by press machines 10, 20 can be secured.

As illustrated in FIG. 5, upstream-side drive belt 122 is an endless belt, and can adjust the relative position of upstream-side drive shaft 116 with respect to upstream-side end shaft 126 in transport direction X. Thus, the tension of upstream-side drive belt 122 can be easily adjusted.

As illustrated in FIG. 7, transport belt 130 is the ended belt having first end 130E1 and second end 130E2, and can adjust the interval between first end 130E1 and second end 130E2 in transport direction X. Thus, the tension of transport belt 130 can be easily adjusted.

The example, in which first drive 110 includes the pair of upstream-side motor 114 and downstream-side motor 134 generating the driving force for transporting the workpiece and includes the pair of upstream-side drive shaft 116 and downstream-side drive shaft 136, has been described in the embodiment described above. First drive 110 may not necessarily include the pair of motors and drive shafts. As long as sufficient torque can be transmitted to transport belt 130, the driving force generated by one motor (only upstream-side motor 114 or only downstream-side motor) may be transmitted to transport belt 130 to transport the workpiece.

The example in which both ends of crossbar 310 are supported by first drive 110 and second drive 260 disposed on both sides in crosswise direction Y has been described in the embodiment. The pair of drives supporting crossbar 310 is not necessarily provided, but one drive may be configured to support one portion of crossbar 310.

Furthermore, workpiece transport device 100 is not necessarily required to include crossbar 310, but may include a finger that can advance and retreat in crosswise direction Y at the distal end portion of the arm portion provided in base portion 300, and the workpiece may be held by the finger. The finger that can advance and retreat in crosswise direction Y also corresponds to the holding portion. Alternatively, the vacuum cup may be attached to the distal end portion of the arm portion without interposing the crossbar.

The example in which workpiece transport device 100 transports the workpiece between press machines 10, 20 constituting the tandem press line has been described in the embodiment. Workpiece transport device 100 of the embodiment may be applied to transport the workpiece between a plurality of dies disposed in one press machine in a transfer press line.

It should be considered that the disclosed embodiment is illustrative and non-restrictive in every respect. The scope of the present invention is defined by not the above description, but the claims, and it is intended that all modifications within the meaning and scope equivalent to the claims are included in the present invention.

REFERENCE SIGNS LIST

10, 20: press machine, 11, 21: slide, 12, 22: upper die, 13, 23: bolster, 14, 24: lower die, 15, 15A, 15B, 25, 25A, 25B: upright, 16, 26: slide arm, 100: workpiece transport device, 110: first drive, 112: frame, 114: upstream-side motor, 116: upstream-side drive shaft, 118: upstream-side speed reducer, 120: upstream-side first pulley, 122: upstream-side drive belt, 124: upstream-side second pulley, 126: upstream-side end shaft, 128: upstream-side third pulley, 130: transport belt, 130E1: first end, 130E2: second end, 134: downstream-side motor, 136: downstream-side drive shaft, 138: downstream-side speed reducer, 140: downstream-side first pulley, 142: downstream-side drive belt, 144: downstream-side second pulley, 146: downstream-side end shaft, 148: downstream-side third pulley, 150: guide rail, 152, 154: linear motion member, 158: carrier, 160: first carrier, 162, 182: rail support, 164, 184: support bolt, 166, 186: belt fixture, 168, 188: fixing bolt, 170, 190: wall portion, 172, 192: bottom plate portion, 180: second carrier, 200, 210: belt fastening plate, 202, 212: outer plate, 204, 214: inner plate, 206, 216: fastening bolt, 220, 226, 228: shim plate, 222, 224: shim adjusting bolt, 260: second drive, 264, 274: motor, 300: base portion, 310: crossbar, X: transport direction

The invention claimed is:

1. A workpiece transport device that transports a workpiece to be press-worked by at least one press machine, the workpiece transport device comprising:

a pair of end shafts disposed apart from each other in a transport direction that is a direction of transport of the workpiece;

a drive shaft disposed between the pair of end shafts in the transport direction;

a drive belt wound around the drive shaft and the end shaft; and a transport belt wound around the pair of end shafts, wherein driving force for transporting the workpiece is transmitted to the transport belt through the drive shaft, the drive belt, and the end shaft in order, the at least one press machine includes a die that moves in a vertical direction and a slide to which the die is attached, the at least one press machine includes a press machine on an upstream side and a press machine on a downstream side in the transport direction, the workpiece transport device transports the workpiece from the press machine on the upstream side to the press machine on the downstream side, the drive shaft is disposed between the slide of the press machine on the upstream side and the slide of the press machine on the downstream side in the transport direction, the at least one press machine includes a column portion extending in the vertical direction, a length between the pair of end shafts in the transport direction is greater than an interval between the press machine on the upstream side and the press machine on the downstream side, and the drive shaft is disposed so as to overlap the column portion in a side view.

2. The workpiece transport device according to claim 1, wherein the at least one press machine further includes an attachment portion attaching the slide to the column portion so as to be movable in the vertical direction, and the drive shaft is disposed between the attachment portion on the downstream side of the press machine on the upstream side and the attachment portion on the upstream side of the press machine on the downstream side in the transport direction.

3. The workpiece transport device according to claim 2, wherein the transport belt is disposed below the attachment portion.

4. The workpiece transport device according to claim 1, wherein the drive belt is an endless belt, and a relative position of the drive shaft with respect to the end shaft in the transport direction is adjustable.

5. The workpiece transport device according to claim 1, wherein the transport belt is an ended belt having a first end and a second end, and an interval between the first end and the second end in the transport direction is adjustable.

* * * * *